US010018414B2

(12) United States Patent
Musicus

(10) Patent No.: US 10,018,414 B2
(45) **Date of Patent: *Jul. 10, 2018**

(54) METHOD FOR THE PRODUCTION OF LOW PRESSURE GASEOUS OXYGEN

(71) Applicant: L'Air Liquide, Société Anonyme Pour L'Étude Et L'Exploitation Des Procedes Georges Claude, Paris (FR)

(72) Inventor: Paul Musicus, Houston, TX (US)

(73) Assignee: L'Air Liquide Societe Anonyme Pour L'Etude Et L'Exploitation Des Procedes Georges Claude, Paris (FR)

( * ) Notice: Subject to any disclaimer, the term of this patent is extended or adjusted under 35 U.S.C. 154(b) by 108 days.

This patent is subject to a terminal disclaimer.

(21) Appl. No.: 14/815,887

(22) Filed: Jul. 31, 2015

(65) Prior Publication Data

US 2017/0030637 A1 Feb. 2, 2017

(51) Int. Cl.
*F25J 1/02* (2006.01)
*F25J 3/04* (2006.01)

(52) U.S. Cl.
CPC ..... *F25J 3/04878* (2013.01); *F25J 3/0406* (2013.01); *F25J 3/04303* (2013.01); *F25J 3/04309* (2013.01); *F25J 3/04351* (2013.01); *F25J 3/04393* (2013.01); *F25J 3/04448* (2013.01); *F25J 2215/54* (2013.01); *F25J 2235/50* (2013.01); *F25J 2240/46* (2013.01); *F25J 2250/20* (2013.01)

(58) Field of Classification Search
CPC .. F25J 3/04412; F25J 3/04187; F25J 3/04878; F25J 3/04884; F25J 3/0406; F25J 3/04503; F25J 3/04309; F25J 2210/40; F25J 2200/40; F25J 2200/50
See application file for complete search history.

(56) References Cited

U.S. PATENT DOCUMENTS

| | | | | |
|---|---|---|---|---|
| 4,817,394 | A * | 4/1989 | Erickson | F25J 3/0409 62/646 |
| 5,964,104 | A * | 10/1999 | Rottmann | F25J 3/04212 62/650 |
| 2007/0095100 | A1* | 5/2007 | Rankin | F25J 3/0409 62/643 |
| 2011/0067445 | A1* | 3/2011 | Davidian | F25J 3/0406 62/652 |
| 2012/0118013 | A1* | 5/2012 | Dubettier-Grenier | F25J 3/0409 62/643 |

* cited by examiner

*Primary Examiner* — Brian King
(74) *Attorney, Agent, or Firm* — Justin K. Murray

(57) ABSTRACT

A method for the production of low pressure gaseous oxygen includes providing a system of distillation columns and a heat exchanger, wherein the system of columns comprises a lower pressure column, a higher pressure column, an auxiliary column, the auxiliary column having a distillation section, a first reboiler, and a second reboiler, wherein the LP column and the HP column are thermally integrated via a top reboiler/condenser disposed on top of the HP column. A cooled air stream is rectified within the system of columns such that the auxiliary column produces a cold oxygen fluid that is then warmed in the heat exchanger to produce a low pressure oxygen product. The cooled air stream provides reboiling duty for the first reboiler prior to rectification within the system of columns, and a compressed nitrogen stream received from a cold end of the heat exchanger provides reboiling duty for the second reboiler.

13 Claims, 2 Drawing Sheets

METHOD FOR THE PRODUCTION OF LOW PRESSURE GASEOUS OXYGEN

TECHNICAL FIELD OF THE INVENTION

The present invention generally relates to a method for producing gaseous oxygen, and more particularly low pressure gaseous oxygen useful for oxy-combustion service and other services.

BACKGROUND OF THE INVENTION

In typical oxygen production, it is common to use one or more auxiliary vaporizers to produce oxygen at pressure, and in the case of multiple auxiliary vaporizers, complicated and expensive air boosting equipment is typical used, which adds further expense to a project.

FIG. 1 represents an embodiment of the prior art. Cooled and purified air from the adsorbers is split into two streams, with one portion going to the higher pressure (HP) column 40 for rectification, and a second portion being used as a reboiling fluid for the reboiler 23 of the auxiliary column 20, where the air is condensed before being introduced to the HP column and optionally the lower pressure (LP) column 80 via streams 6 and 8, respectively. HP column 40 and LP column 80 are thermally integrated via reboiler 41.

HP column 40 is configured to operate under conditions effective to separate the air into nitrogen and oxygen. Crude oxygen stream 42 is removed from the bottom of HP column 40, optionally cooled in auxiliary heat exchanger (not shown), reduced in pressure via a valve and introduced to a middle section of LP column 80 for separation therein.

Within HP column 40, nitrogen vapor rises towards the top and ultimately is condensed in the reboiler 41 before being reintroduced to the top of HP column 40 as liquid. Nitrogen-rich liquid 47 is then withdrawn from a top portion of HP column 40, optionally cooled in auxiliary heat exchanger (not shown), reduced in pressure via a valve, and then introduced to the top of LP column 80.

Oxygen-rich liquid 82 is withdrawn from a bottom portion of LP column 80, and pumped by second pump P2 to the reboiler that is fixed atop of HP column 40. The oxygen-rich liquid introduced to the reboiler provides the refrigeration necessary to condense the nitrogen vapor coming from HP column 40. During the course of operation, the heat provided by the nitrogen vapor causes some of the oxygen-rich liquid to vaporize. Oxygen-rich gas 44 is withdrawn from the top of the reboiler and introduced to the bottom portion of LP column 80 for further separation therein. Oxygen-rich liquid 49 is withdrawn from a bottom part of the reboiler and sent to a top portion of auxiliary column 20 for further separation therein.

Auxiliary column 20 contains a single reboiler 23 that uses a cooled and purified air stream as the reboiling fluid. This air stream is condensed within the single reboiler 23 and then combined with another air stream before one portion 6 is sent to the HP column and a second portion 8 is sent to the LP column for separation therein.

Oxygen-rich liquid accumulates in the bottom portion of auxiliary column 20 (e.g., the portion below the distillation section). As noted previously, cooled, purified air provides reboiling duty for reboiler 23, which causes some of the oxygen-rich liquid (as well as any other impurities such as nitrogen) to boil off and travel through the distillation media and ultimately withdrawn from the top of auxiliary column 20 as oxygen overheads 22 before being introduced to the bottom portion of LP column 80.

Liquid oxygen 27 is withdrawn from auxiliary column 20, pressurized to a higher pressure than the LP column (and auxiliary column 20) and sent to auxiliary vaporizer 30. Air coming from a booster air compressor is used as a vaporizing fluid for the vaporizer of auxiliary vaporizer 30. Gaseous oxygen is withdrawn from the top of auxiliary vaporizer 30 and collected as product.

Notably, in the embodiment shown in FIG. 1, auxiliary vaporizer 30 operates at a pressure higher than the LP column, and the auxiliary column 20 operates at a pressure substantially the same as the LP column.

In addition, the complicated separate auxiliary vaporizers and their associated piping and valves are expensive as well. This also leads to an increase in cold box volumes further raising the cost of the facility.

Therefore, it would be desirable to have an improved apparatus and method that avoids these added expenses and operates in an overall more efficient manner.

SUMMARY OF THE INVENTION

The present invention is directed to a method that satisfies at least one of these needs. In one embodiment, the method can include elimination of auxiliary vaporizers by operating the lower, and separate, portion of a lower pressure column at the delivery pressure of the oxygen. In one embodiment, reboil of the LP column can be accomplished using two stacked reboilers, with one driven by pressurized nitrogen and the other driven by pressurized air. In one embodiment, a nitrogen turbine/booster can be used. In another embodiment, an air turbine/booster can be used. Those of ordinary skill in the art will recognize that other turbine arrangements are possible.

In one embodiment, a method for the production of low pressure gaseous oxygen can include the steps of:

a) cooling a compressed and purified air stream in a heat exchanger, the heat exchanger having a warm end, a cold end, and an intermediate section;

b) withdrawing the compressed and purified air stream from the cold end of the heat exchanger and introducing the compressed and purified air stream to a first reboiler such that the compressed and purified air stream acts as a reboiling fluid for the first reboiler such that an at least partially condensed air stream is formed, wherein the first reboiler is disposed within an auxiliary column, the auxiliary column further comprising a distillation section and a second reboiler, wherein the second reboiler is configured to use a pressurized nitrogen stream as its reboiling fluid;

c) withdrawing the at least partially condensed air stream from first reboiler;

d) introducing at least a first air portion to a higher pressure (HP) column under conditions effective to separate the first air portion into a nitrogen-rich fluid at the top of the HP column and a crude oxygen stream at the bottom of the HP column;

e) withdrawing the crude oxygen stream from the bottom of the HP column and expanding the crude oxygen stream to a pressure matching a pressure of the lower pressure (LP) column and then introducing crude oxygen stream to the LP column under conditions effective to separate the crude oxygen stream into a waste nitrogen gas at the top of the LP column and an oxygen-rich liquid at the bottom of the LP column, f) withdrawing the nitrogen-rich fluid from the top of the HP column and compressing at least a first portion of the nitrogen-rich fluid in a cold compressor to produce the pressurized nitrogen;

g) cooling the pressurized nitrogen in the heat exchanger;

h) withdrawing the pressurized nitrogen from the cold end of the heat exchanger and introducing the pressurized nitrogen to the second reboiler such that the pressurized nitrogen acts as a reboiling fluid for the second reboiler and the pressurized nitrogen at least partially condenses;

i) withdrawing the pressurized nitrogen from the second reboiler;

j) introducing at least a first nitrogen portion of the pressurized nitrogen to the HP column;

k) withdrawing the oxygen-rich liquid from the bottom of the LP column and then sending the oxygen-rich liquid to a reboiler disposed on top of the HP column, wherein the top reboiler is configured to condense nitrogen vapor from the HP column;

l) withdrawing a second oxygen-rich liquid from the reboiler, pressurizing the second oxygen-rich liquid to a pressure exceeding the operating pressure of the LP column to form a pressurized oxygen-rich liquid, and then sending the pressurized oxygen-rich liquid to the auxiliary column for separation therein;

m) withdrawing a gaseous oxygen stream from the auxiliary column at a point above the first and second reboilers and below the distillation section; and n) warming the gaseous oxygen stream in the heat exchanger to produce a low pressure gaseous oxygen product.

In optional embodiments of the method for the production of low pressure gaseous oxygen:

the first reboiler and the second reboiler are disposed in a vertical arrangement with each other;

the first reboiler is disposed above the second reboiler within the auxiliary column;

the first reboiler is disposed in the same horizontal plane as the second reboiler within the auxiliary column;

the method can also include the steps of sending a second portion of the pressurized nitrogen-rich fluid to the cold end of the heat exchanger and warming said pressurized nitrogen-rich fluid to an intermediate temperature; withdrawing the pressurized nitrogen-rich fluid from the intermediate section of the heat exchanger and expanding the pressurized nitrogen-rich fluid in a nitrogen expander to form a low pressure gaseous nitrogen; and warming the low pressure gaseous nitrogen in the heat exchanger; and/or the method is practiced without vaporizing oxygen in an auxiliary vaporizer.

In another aspect of the invention, the method for the production of low pressure gaseous oxygen can include the steps of providing a system of distillation columns and a heat exchanger, wherein the system of columns comprises a lower pressure (LP) column, a higher pressure (HP) column, an auxiliary column, the auxiliary column having a distillation section, a first reboiler, and a second reboiler, wherein the LP column and the HP column are thermally integrated via a condenser/reboiler disposed on top of the HP column; rectifying a cooled air stream within the system of columns such that the auxiliary column produces a cold oxygen fluid; warming the cold oxygen fluid in the heat exchanger to produce a low pressure oxygen product; using the cooled air stream to provide reboiling duty for the first reboiler prior to rectification within the system of columns; and using a compressed nitrogen stream received from a cold end of the heat exchanger to provide reboiling duty for the second reboiler.

In optional embodiments of the method for the production of low pressure gaseous oxygen:

the first reboiler and the second reboiler are configured in a stacked fashion;

the first reboiler is disposed above the second reboiler;

the method is practiced without vaporizing oxygen in an auxiliary vaporizer; and the auxiliary column operates at a pressure that is higher than the operating pressure of the LP column.

BRIEF DESCRIPTION OF THE DRAWINGS

These and other features, aspects, and advantages of the present invention will become better understood with regard to the following description, claims, and accompanying drawings. It is to be noted, however, that the drawings illustrate only several embodiments of the invention and are therefore not to be considered limiting of the invention's scope as it can admit to other equally effective embodiments.

DETAILED DESCRIPTION

While the invention will be described in connection with several embodiments, it will be understood that it is not intended to limit the invention to those embodiments. On the contrary, it is intended to cover all the alternatives, modifications and equivalence as may be included within the spirit and scope of the invention defined by the appended claims.

Figure 2:
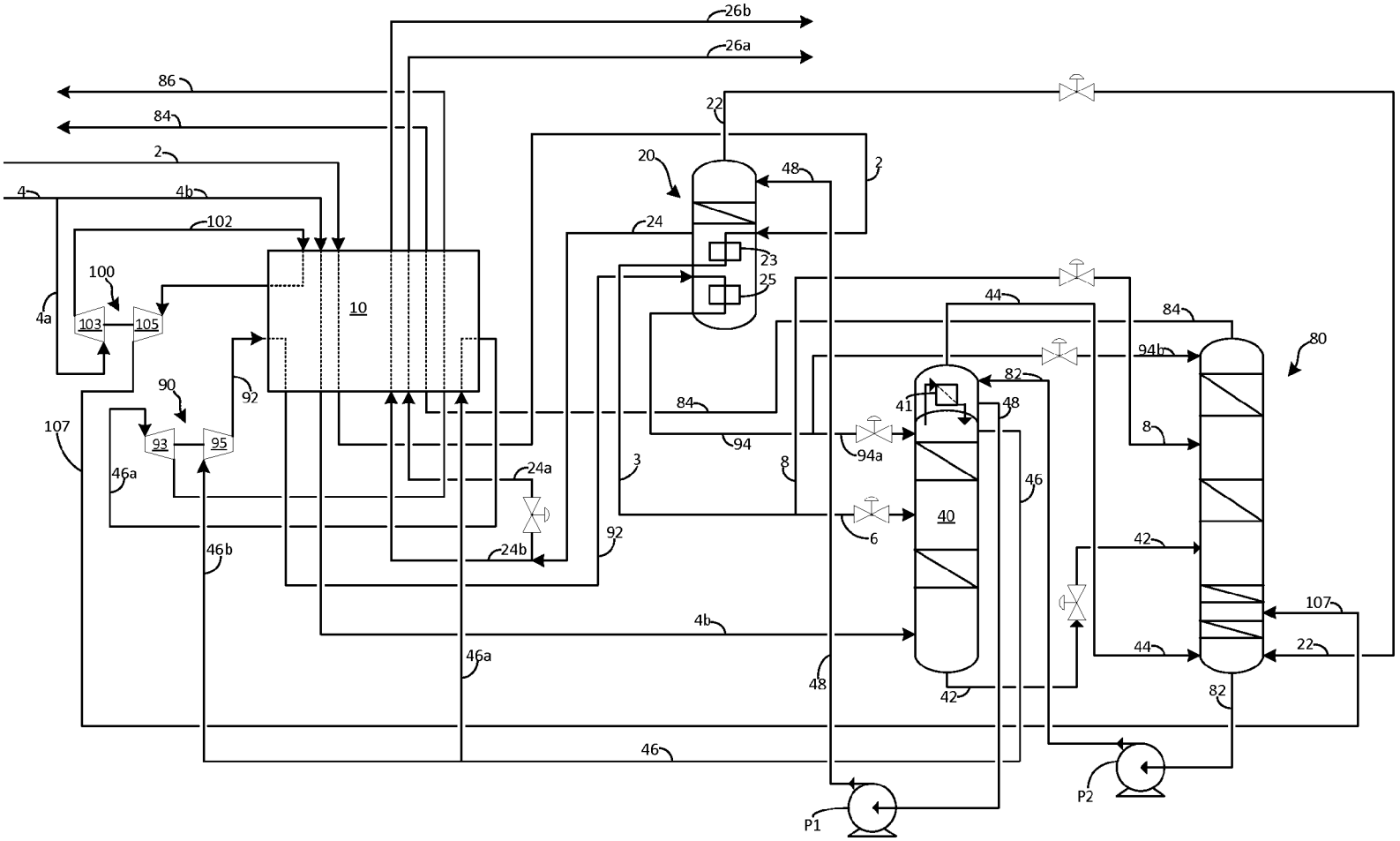
FIG. 2 shows an embodiment of the present invention.

FIG. 2 represents an embodiment of the present invention. In this embodiment, compressed and purified air 2 from a booster air compressor (not shown) is cooled in heat exchanger 10 and then used to provide reboiling duties for air driven reboiler 23, thereby condensing at least a portion of the air to form partially condensed air 3. In a preferred embodiment, all of the air is condensed. First air portion 6 is reduced in pressure by a valve and then introduced into a middle section of higher pressure (HP) column 40 for separation therein. In the embodiment shown, second air portion 8 is reduced in pressure by a valve before being introduced to a middle section of lower pressure (LP) column 80 for separation therein. In an optional embodiment, all of the air is sent to HP column 40.

In an optional embodiment not shown, partially condensed air 3 can be sent to a liquid gas separator, whereby a gaseous air fraction is withdrawn from the top and introduced to a middle section of HP column 40, and a condensed air fraction is withdrawn from the bottom and a first portion is introduced to the middle section of HP column 40 at a point below the gaseous air fraction. Additionally, the second air portion 8 can be cooled in an auxiliary heat exchanger prior to being sent to a second liquid gas separator, wherein a gaseous air fraction is withdrawn from the top and introduced to the middle section of the LP column 80, and a condensed air fraction is withdrawn from the bottom and is introduced to the middle section of the LP column 80 at a point below the gaseous air fraction.

Air from adsorbers 4 is split into first portion 4*a* and second portion 4*b*. First portion 4*a* is compressed in air booster 103 of air turbine/booster 100 to form compressed air 102, which preferably is at a pressure between 4 bara and 5.5 bara, more preferably between 4.5 bara and 5 bara. Compressed air 102 is then partially cooled in heat exchanger 10 and withdrawn from an intermediate location of heat exchanger 10 and then expanded in air turbine 105 of turbine/booster 100 to form expanded air 107, before being introduced to LP column 80 for separation therein. After expansion, expanded air 107 is preferably at the substantially same pressure as LP column 80 (except to account for pressure drops within the lines). Second portion of air from adsorbers 4*b* is then fully cooled in heat exchanger 10 and sent to a bottom section of HP column 40 for separation therein.

HP column 40 is configured to operate under conditions effective to separate the air into nitrogen and oxygen. Crude oxygen stream 42 is removed from the bottom of HP column 40, optionally cooled in auxiliary heat exchanger (not shown), reduced in pressure via a valve and introduced to a middle section of LP column 80 for separation therein. In an optional embodiment not shown, following expansion in the valve, crude oxygen stream 42 can be introduced to a gas liquid separator. Gaseous overheads can be withdrawn from the top and introduced to the middle section of LP column 80 and liquid bottoms can be withdrawn from the bottom and introduced to the middle section of LP column 80 at a point below gaseous overheads.

Within HP column 40, nitrogen vapor rises towards the top and ultimately are condensed in the reboiler 41 before being reintroduced to the top of HP column 40 as liquid. Nitrogen-rich gas 46 is then withdrawn from a top portion of HP column 40 and split into two streams: first portion of nitrogen-rich gas 46*a* and second portion of nitrogen-rich gas 46*b*. First portion of nitrogen-rich gas 46*a* is partially warmed in heat exchanger 10 before being expanded in nitrogen turbine 93 of nitrogen turbine/booster 90. The resulting low pressure nitrogen is then warmed in heat exchanger 10 to become LP gaseous nitrogen 86, that can be used to regenerate the adsorbers. Second portion of nitrogen-rich gas 46*b* is compressed in nitrogen compressor 95 of nitrogen turbine/booster 90 to form pressurized nitrogen 92, which is then introduced to an intermediate portion of heat exchanger 10 and cooled. Pressurized nitrogen 92 is then used to provide reboiling duties for nitrogen driven reboiler 25 to form cooled nitrogen 94, which is preferably fully condensed. Cooled nitrogen 94 is then split into two streams, with first portion of cooled nitrogen 94*a* going to the top portion of HP column 40 and second portion of cooled nitrogen 94*b* going to the top portion of LP column 80. In one embodiment, all of the cooled nitrogen is introduced to the HP column.

Oxygen-rich liquid 82 is withdrawn from a bottom portion of LP column 80, and pumped by second pump P2 to the reboiler that is fixed atop of HP column 40. In the embodiment shown, the two columns are shown side by side; however, in an alternative embodiment, the two columns may be part of a traditional stacked double column. In the embodiment using a stacked column, second pump P2 would not be used. In the embodiment shown, second pump P2 is preferably used in order to overcome the static pressure. The oxygen-rich liquid introduced to the reboiler provides the refrigeration necessary to condense the nitrogen vapor coming from HP column 40. During the course of operation, the heat provided by the nitrogen vapor causes some of the oxygen-rich liquid to vaporize. Oxygen-rich gas 44 is withdrawn from the top of the reboiler and introduced to the bottom portion of LP column 80 for further separation therein. Oxygen-rich liquid 48 is withdrawn from a bottom part of the reboiler, pressurized in first pump P1 and then sent to a top portion of auxiliary column 20 for further separation therein. In one embodiment, auxiliary column 20 operates at a pressure that is higher than the operating pressure of the LP column.

Auxiliary column 20 contains two reboilers: air driven reboiler 23 and nitrogen driven reboiler 25. In a preferred embodiment, air driven reboiler 23 and nitrogen driven reboiler 25 are arranged in a stacked, vertical fashion. In one embodiment, air driven reboiler 23 is located above nitrogen driven reboiler 25. In another embodiment, the two reboilers are arranged in the same horizontal plane. It is preferable; however, to have the two reboilers arranged in a stacked, vertical fashion such that the overall diameter of auxiliary column 20 can be minimized. In one embodiment, air driven reboiler 23 is smaller in size as compared to nitrogen driven reboiler 25. In one embodiment, air driven reboiler 23 and nitrogen driven reboiler 25 operate at nearly the same temperatures.

Oxygen-rich liquid accumulates in the bottom portion of auxiliary column 20 (e.g., the portion below the distillation section). As noted previously, compressed and purified air 2 provides reboiling duty for air driven reboiler 23 and pressurized nitrogen 92 provides reboiling duty for nitrogen driven reboiler 25, which causes some of the oxygen-rich liquid (as well as any other impurities such as nitrogen) to boil off and travel through the distillation media and is ultimately withdrawn from the top of auxiliary column 20 as oxygen overheads 22 before being expanded through a valve and then introduced to the bottom portion of LP column 80.

Low pressure gaseous oxygen (LP GOX) 24 is withdrawn from auxiliary column 20 and split into two streams: first portion of LP GOX 24*a* and second portion of LP GOX 24*b*. Second portion of LP GOX 24*b* is heated in heat exchanger 10 to produce second LP GOX product. First portion of LP GOX 24*a* is reduced in pressure via a valve, heated in heat exchanger 10 to produce first LP GOX product 26*a*.

Waste nitrogen 84 is withdrawn from the top portion of LP column 80 and then introduced to heat exchanger 10 to capture some of its refrigeration. In an optional embodiment, following heating in heat exchanger 10, waste nitrogen 84 can be used for precooling elsewhere in the process.

EXAMPLES

Figure 1:
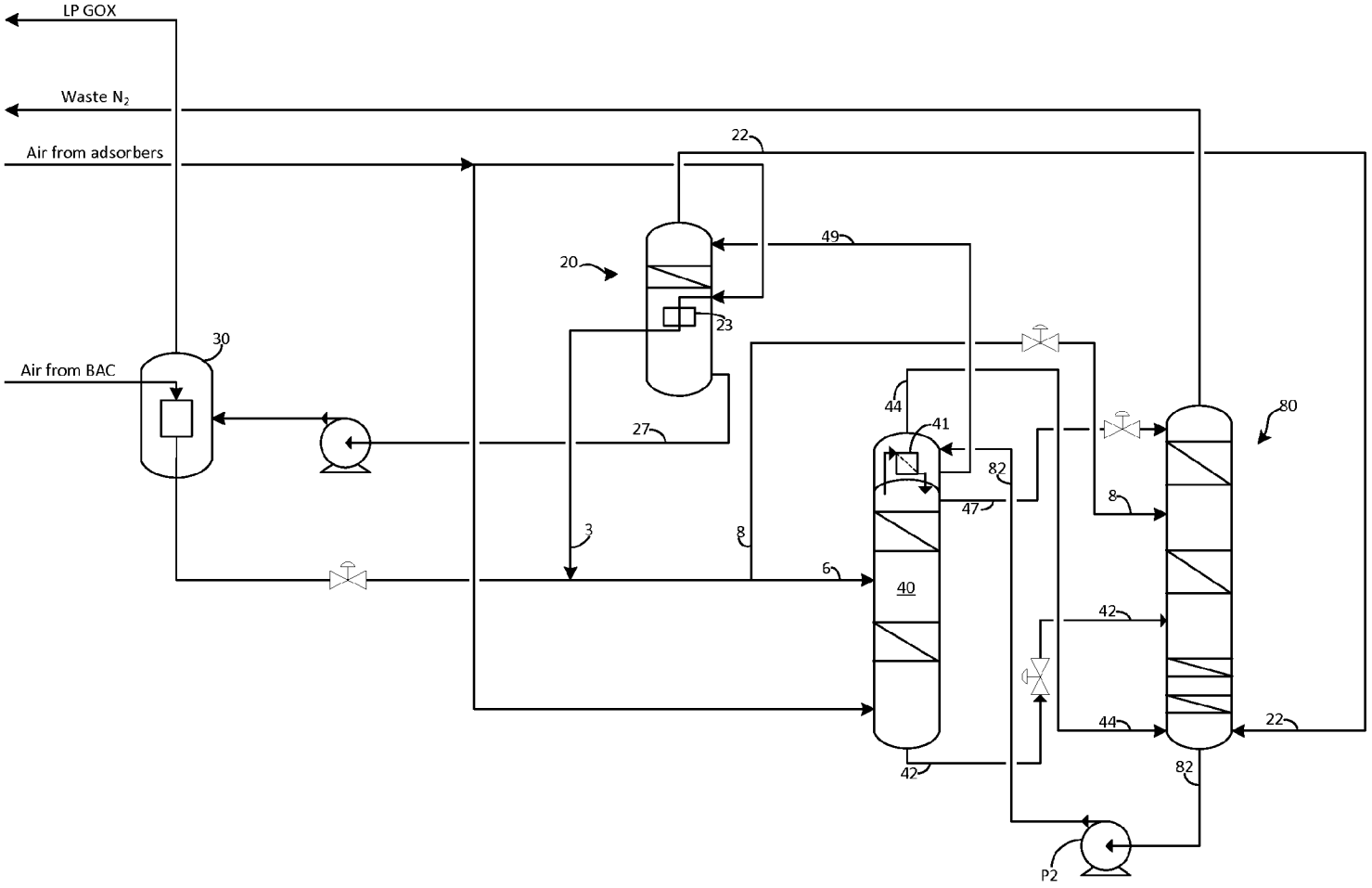
FIG. 1 (Prior Art)
FIG. 1 provides an embodiment of the prior art.

Simulations were conducted in order to compare the results of an embodiment from the prior art (FIG. 1) vs. an embodiment of the present invention (FIG. 2). Pressure, temperature, flow rates, and compositions of various streams of FIG. 1 can be found in Table I below:

TABLE I

Data for Embodiment of the Prior Art

| STREAM | TEMP. ° C. | PRESSURE BARA | FLOW $NM^3/Hr$ | $N_2$ MOL % | AR MOL % | $O_2$ MOL % |
|---|---|---|---|---|---|---|
| 3 | −179.8 | 3.468 | 316348 | 78.11% | 0.93% | 20.96% |
| 6 | −182.0 | 3.344 | 51452 | 78.11% | 0.93% | 20.96% |
| 8 | −182.0 | 3.344 | 65850 | 78.11% | 0.93% | 20.96% |
| 22 | −184.0 | 1.257 | 58276 | 34.24% | 4.30% | 61.45% |
| 27 | −181.0 | 1.273 | 93039 | 0.07% | 3.43% | 96.50% |
| 42 | −180.0 | 3.468 | 212109 | 62.68% | 1.43% | 35.89% |
| 44 | −184.3 | 1.252 | 160062 | 36.76% | 4.09% | 59.15% |
| 47 | −183.7 | 3.438 | 92911 | 99.38% | 0.24% | 0.38% |
| 49 | −184.3 | 1.252 | 151315 | 13.23% | 3.77% | 83.00% |
| 82 | −186.5 | 1.249 | 311377 | 25.32% | 3.93% | 70.74% |
| LPGOX | 17.7 | 1.570 | 93039 | 0.07% | 3.43% | 96.50% |

Pressure, temperature, flow rates, and compositions of various streams for the embodiment shown in FIG. 2 can be found in Table II below:

TABLE II

Data for Embodiment of the Present Invention

| STREAM | TEMP. ° C. | PRESSURE BARA | FLOW $NM^3/Hr$ | $N_2$ MOL % | AR MOL % | $O_2$ MOL % |
|---|---|---|---|---|---|---|
| 2 | 21.2 | 5.150 | 77615 | 78.11% | 0.93% | 20.96% |
| 3 | −176.8 | 5.057 | 77615 | 78.11% | 0.93% | 20.96% |
| 4 | 20.6 | 3.490 | 356295 | 78.11% | 0.93% | 20.96% |
| 4a | 20.6 | 3.490 | 48235 | 78.11% | 0.93% | 20.96% |
| 4b | 20.6 | 3.490 | 308060 | 78.11% | 0.93% | 20.96% |
| 6 | −176.8 | 5.057 | 48409 | 78.11% | 0.93% | 20.96% |
| 8 | −176.8 | 5.057 | 29206 | 78.11% | 0.93% | 20.96% |
| 22 | −181.6 | 1.672 | 54839 | 39.41% | 3.07% | 57.51% |
| 24 | −177.9 | 1.693 | 92162 | 0.66% | 2.84% | 96.50% |
| 24a | −177.9 | 1.693 | 73554 | 0.66% | 2.84% | 96.50% |
| 24b | −177.9 | 1.693 | 18608 | 0.66% | 2.84% | 96.50% |
| 26a | 18.0 | 1.300 | 73554 | 0.66% | 2.84% | 96.50% |
| 26b | 18.0 | 1.570 | 18608 | 0.66% | 2.84% | 96.50% |
| 42 | −179.4 | 3.351 | 166066 | 54.42% | 1.53% | 44.05% |
| 44 | −184.6 | 1.249 | 93958 | 40.52% | 3.06% | 56.42% |
| 46 | −183.9 | 3.321 | 228000 | 98.90% | 0.40% | 0.70% |
| 46a | −183.9 | 3.321 | 100552 | 98.90% | 0.40% | 0.70% |
| 46b | −183.9 | 3.321 | 127448 | 98.90% | 0.40% | 0.70% |
| 48 | −184.6 | 1.249 | 147879 | 15.03% | 2.92% | 82.05% |
| 82 | −186.4 | 1.249 | 241837 | 24.93% | 2.97% | 72.09% |
| 84 | −194.0 | 1.221 | 244910 | 99.00% | 0.42% | 0.58% |
| 86 | 18.0 | 1.079 | 100552 | 98.90% | 0.40% | 0.70% |
| 92 | −164.0 | 5.974 | 127448 | 98.90% | 0.40% | 0.70% |
| 94 | −176.8 | 5.934 | 127448 | 98.90% | 0.40% | 0.70% |
| 94a | −176.8 | 5.934 | 37598 | 98.90% | 0.40% | 0.70% |
| 94b | −184.0 | 3.321 | 89850 | 98.90% | 0.40% | 0.70% |
| 102 | 21.2 | 4.450 | 52827 | 78.11% | 0.93% | 20.96% |
| 107 | −180.6 | 1.249 | 52827 | 78.11% | 0.93% | 20.96% |

As shown in Table I and Table II above, an embodiment of the present invention can produce a low pressure oxygen product of similar quality (96.5% oxygen) and flow rate (92,162 $Nm^3/hr$ vs. 93,039 $Nm^3/hr$) while eliminating auxiliary vaporizer 30 and the associated piping and valves. As such, embodiments of the current invention provide an improvement over the prior art in terms of simplicity and lower capital expenditures.

In addition to the elimination of auxiliary vaporizers and their related piping and valves, other advantages of operating in accordance with various embodiments of the present invention include an approximately 42% reduction in size of the main condenser (e.g., condenser/reboiler 41, sometimes referred to herein as reboiler) and approximately 2% reduction in size of the auxiliary column 20.

The terms "nitrogen-rich" and "oxygen-rich" will be understood by those skilled in the art to be in reference to the composition of air. As such, nitrogen-rich encompasses a fluid having a nitrogen content greater than that of air. Similarly, oxygen-rich encompasses a fluid having an oxygen content greater than that of air. While FIG. 2 shows the higher pressure and lower pressure columns being side by side, in an alternate embodiment, the columns can also be stacked in a typical double column configuration. Advantageously, the embodiment shown in FIG. 2 allows for improved operating pressures, since the HP column can be operated at a lower pressure than if the two columns were stacked due to the absence of having to overcome static pressure losses.

As used herein, an auxiliary vaporizer is a vaporizer that is located outside of the distillation columns and operates at a pressure other than those of the distillation columns.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

I claim:

1. A method for the production of low pressure gaseous oxygen, the method comprising the steps of:

a) cooling a compressed and purified air stream in a heat exchanger, the heat exchanger having a warm end, a cold end, and an intermediate section;

b) withdrawing the compressed and purified air stream from the cold end of the heat exchanger and introducing the compressed and purified air stream to a first reboiler such that the compressed and purified air stream acts as a reboiling fluid for the first reboiler such that an at least partially condensed air stream is formed, wherein the first reboiler is disposed within a auxiliary column, the auxiliary column further comprising a distillation section and a second reboiler, wherein the second reboiler is configured to use a pressurized nitrogen stream as a reboiling fluid for the second reboiler;

c) withdrawing the at least partially condensed air stream from first reboiler;

d) introducing at least a first air portion to a higher pressure (HP) column under conditions effective to separate the first air portion into a nitrogen-rich fluid at the top of the HP column and a crude oxygen stream at the bottom of the HP column;

e) withdrawing the crude oxygen stream from the bottom of the HP column and expanding the crude oxygen stream to a pressure matching a pressure of the lower pressure (LP) column and then introducing crude oxygen stream to the LP column under conditions effective to separate the crude oxygen stream into a waste nitrogen gas at the top of the LP column and an oxygen-rich liquid at the bottom of the LP column, f) withdrawing the nitrogen-rich fluid from the top of the HP column and compressing at least a first portion of the nitrogen-rich fluid in a cold compressor to produce the pressurized nitrogen;

g) cooling the pressurized nitrogen in the heat exchanger;

h) withdrawing the pressurized nitrogen from the cold end of the heat exchanger and introducing the pressurized nitrogen to the second reboiler such that the pressurized nitrogen acts as a reboiling fluid for the second reboiler and the pressurized nitrogen at least partially condenses;

i) withdrawing the pressurized nitrogen from the second reboiler;

j) introducing at least a first nitrogen portion of the pressurized nitrogen to the HP column;

k) withdrawing the oxygen-rich liquid from the bottom of the LP column and then sending the oxygen-rich liquid to a top reboiler disposed on top of the HP column, wherein the top reboiler is configured to condense nitrogen vapor from the HP column;

l) withdrawing a second oxygen-rich liquid from the top reboiler, pressurizing the second oxygen-rich liquid to a pressure exceeding the operating pressure of the LP column to form a pressurized oxygen-rich liquid, and then sending the pressurized oxygen-rich liquid to the auxiliary column for separation therein;

m) withdrawing a gaseous oxygen stream from the auxiliary column at a point above the first and second reboiler and below the distillation section; and n) warming the gaseous oxygen stream in the heat exchanger to produce a low pressure gaseous oxygen product.

2. The method as claimed in claim 1, wherein the first reboiler and the second reboiler are disposed in a vertical arrangement with each other.

3. The method as claimed in claim 1, wherein the first reboiler is disposed above the second reboiler within the auxiliary column.

4. The method as claimed in claim 1, wherein the first reboiler is disposed in the same horizontal plane as the second reboiler within the auxiliary column.

5. The method as claimed in claim 1, further comprising the steps of sending a second portion of the pressurized nitrogen-rich fluid to the cold end of the heat exchanger and warming said pressurized nitrogen-rich fluid to an intermediate temperature; withdrawing the pressurized nitrogen-rich fluid from the intermediate section of the heat exchanger and expanding the pressurized nitrogen-rich fluid in a nitrogen expander to form a low pressure gaseous nitrogen; and warming the low pressure gaseous nitrogen in the heat exchanger.

6. The method as claimed in claim 1, wherein the auxiliary column operates at a pressure that is higher than the operating pressure of the LP column.

7. A method for the production of low pressure gaseous oxygen, the method comprising the steps of:

providing a system of distillation columns and a heat exchanger, wherein the system of columns comprises a lower pressure (LP) column, a higher pressure (HP) column, an auxiliary column, the auxiliary column having distillation media, a first reboiler, and a second reboiler, wherein the LP column and the HP column are thermally integrated via a top reboiler disposed on top of the HP column;

rectifying a cooled air stream within the system of columns such that the auxiliary column produces a cold oxygen fluid;

warming the cold oxygen fluid in the heat exchanger to produce a low pressure oxygen product;

using the cooled air stream to provide reboiling duty for the first reboiler prior to rectification within the system of columns; and using a compressed nitrogen stream received from a cold end of the heat exchanger to provide reboiling duty for the second reboiler, wherein there is an absence of the distillation media disposed between the first reboiler and the second reboiler of the auxiliary column.

8. The method as claimed in claim 7, wherein the first reboiler and the second reboiler are configured in a stacked fashion.

9. The method as claimed in claim 8, wherein the first reboiler is disposed above the second reboiler.

10. The method as claimed in claim 7, wherein the auxiliary column operates at a pressure that is higher than the operating pressure of the LP column.

11. The method as claimed in claim 7, wherein the first reboiler and the second reboiler are disposed in the auxiliary column such that the first reboiler and the second reboiler operate at the same temperatures.

12. The method as claimed in claim 7, wherein the distillation media is disposed above the first reboiler and the second reboiler.

13. The method as claimed in claim 7, wherein there is an absence of the distillation media disposed below the first reboiler, wherein there is an absence of the distillation media disposed below the second reboiler.

* * * * *